US007543389B2

(12) United States Patent
Grace, Jr.

(10) Patent No.: US 7,543,389 B2
(45) Date of Patent: Jun. 9, 2009

(54) PEEP SIGHT AND RELATED METHOD OF MANUFACTURE

(75) Inventor: Louis Grace, Jr., North Street, MI (US)

(73) Assignee: Grace Engineering Corp., Memphis, MI (US)

( * ) Notice: Subject to any disclaimer, the term of this patent is extended or adjusted under 35 U.S.C. 154(b) by 225 days.

(21) Appl. No.: 11/549,388

(22) Filed: Oct. 13, 2006

(65) Prior Publication Data

US 2007/0119060 A1 May 31, 2007

Related U.S. Application Data

(60) Provisional application No. 60/727,626, filed on Oct. 19, 2005.

(51) Int. Cl.
*F41G 1/467* (2006.01)

(52) U.S. Cl. ..... 33/265; 124/87

(58) Field of Classification Search ..... 33/265; 124/87, 90–92

See application file for complete search history.

(56) References Cited

U.S. PATENT DOCUMENTS

| | | | | | |
|---|---|---|---|---|---|
| 3,859,733 | A | | 1/1975 | Chesnick | |
| 4,011,853 | A | | 3/1977 | Fletcher | |
| 4,116,194 | A | | 9/1978 | Topel | |
| 4,895,129 | A | * | 1/1990 | Hedgpeth | 124/87 |
| 4,934,332 | A | * | 6/1990 | Scherz | 124/87 |
| 5,056,498 | A | | 10/1991 | Scherz | |
| 5,080,084 | A | * | 1/1992 | Kendall et al. | 124/87 |
| 5,347,976 | A | | 9/1994 | Saunders | |
| 5,542,186 | A | * | 8/1996 | Saunders | 33/265 |
| 5,787,870 | A | * | 8/1998 | Summers et al. | 124/91 |
| 6,058,921 | A | | 5/2000 | Lawrence et al. | |
| 6,282,800 | B1 | * | 9/2001 | Beutler | 33/265 |
| 6,860,021 | B1 | * | 3/2005 | Connelly, III | 33/265 |
| 6,981,329 | B1 | | 1/2006 | Strathman | |
| 7,373,723 | B1 | * | 5/2008 | Tupper, Jr. | 33/265 |
| 2008/0066328 | A1 | * | 3/2008 | Bohn | 33/265 |

OTHER PUBLICATIONS

Printout from http://www.scorpyontechnologies.com printed Oct. 13, 2006.

* cited by examiner

*Primary Examiner*—Yaritza Guadalupe-McCall
(74) *Attorney, Agent, or Firm*—Warner Norcross & Judd LLP

(57) ABSTRACT

A peep sight for an archery bow. The peep sight can define a peep aperture bounded by a curvilinear bulge optionally constructed from magnesium or a magnesium alloy. The peep sight bulge can circumferentiate the peep aperture, and can form an apex about midway between a forward surface and a rearward surface of the peep sight. The peep sight can define a serving slot and two or more angled bowstring strand slots for receiving portions of the bowstring strands to mount the peep sight to a bowstring. The peep sight can be blue in color. A method is provided including: machining a magnesium, magnesium alloy and/or other material blank into a peep body; and removing a portion of a peep body to define a peep aperture bound by a curvilinear bulge. Optionally, a strand slot and/or a serving slot can be machined into a surface of the body.

19 Claims, 4 Drawing Sheets

PEEP SIGHT AND RELATED METHOD OF MANUFACTURE

This application claims benefit of U.S. provisional patent application 60/727,626, filed Oct. 19, 2005, which is hereby incorporated by reference.

BACKGROUND OF THE INVENTION

The present invention relates to archery sighting devices, and more particularly to a peep sight for an archery bow.

Peep sights generally are used on archery bows to assist in aiming. A peep sight usually is mounted on the string of the bow at a predetermined distance above a nocking point on the bowstring. The peep sight is secured to the string by separating strands of the bowstring and securing the peep between those strands. The peep sight includes a peep aperture alignable with a line of sight of an archer when the archer aims at a target. Specifically, when the archer draws the bowstring, the archer aims at a target by viewing it through the peep aperture and by aligning the peep aperture and a front sight mounted on the bow with the target. In effect, the peep sight ensures that the archer consistently aims the bow, which thereby improves accuracy.

Conventional peep sights are manufactured from aluminum or plastics. Both materials present issues with respect to energy imparted by the bowstring to which the peep sights are mounted. Specifically, because peep sights are mounted on the bowstring, the additional weight of an aluminum peep sight on the bowstring has a deleterious affect on kinetic energy of the string, and thus the energy and velocity imparted to an arrow shot from the bow. Theoretically, plastic peep sights are lighter than aluminum sights; however, plastic peep sights usually are the same weight as aluminum peeps due to the material added to the plastic peep to provide strength comparable to an aluminum peep. Accordingly, conventional aluminum and plastic peeps have weight issues that affect performance.

Another issue with many peep sights is that the peep aperture construction can make it difficult to aim in low light conditions, such as that encountered when bow hunting at dusk or dawn. For example, most peep apertures of aluminum or plastic peeps are cylindrical bores. In low light conditions, the cylindrical bore impedes visual clarity and targeting visibility. One solution to this problem is presented in U.S. Pat. No. 6,981,329 to Strathman, wherein the peep aperture of a plastic or aluminum sight includes two opposing, intersecting frusto-conical recesses which are tapered equally at approximately 35° to 45° to equally deflect light and form an inside, defined edge of the peep sight aperture. Although the Stratham peep construction can sometimes provide improved target visibility, many times it can deflect too much light. This can sometimes make it difficult to focus through the peep sight, particularly in low light conditions.

SUMMARY OF THE INVENTION

The aforementioned problems are overcome by a peep sight, optionally manufactured from magnesium or a magnesium alloy, that defines an hourglass-shaped peep aperture.

In one embodiment, the peep sight includes a curvilinear bulge that defines the peep aperture. This bulge can circumferentiate the peep aperture, and thereby contribute to and/or form the hourglass-shaped peep aperture. Optionally, the bulge includes a constant or uniform radius. Further optionally, the curvilinear bulge includes an apex centered generally between a front surface and a rear surface of the peep sight.

In another embodiment, the peep defines one or more bowstring strand slots which enable the longitudinal axis of the aperture to be aligned along a preferred axis of viewing for the archer.

In a further embodiment, the peep sight includes a generally circular outer surface which defines a circumferential serving groove. This circumferential groove can intersect the one or more bowstring strand slots and provide a location for a serving to secure the peep on the bowstring.

In yet another embodiment, the peep sight is substantially blue, at least on its exterior surface. Being of this color, the peep sight provides improved aiming ability in low light conditions.

In yet a further embodiment, the present invention provides a method of manufacturing a peep sight. The method includes providing an optional magnesium or magnesium alloy blank; machining the blank to define a peep sight aperture bounded by a curvilinear bulge. Optionally, the curvilinear bulge circumferentiates the aperture and is of a uniform radius.

The present invention provides a light, simple and efficient peep sight. The hourglass peep aperture facilitates rapid target acquisition and aiming, enhances contrast between the peep and the target, and is suitable for low light shooting conditions. When the peep is constructed from a magnesium or magnesium alloy, it provides a significant weight advantage over conventional aluminum and/or plastic peep sights. Specifically, the magnesium or magnesium alloy peep can provide at least a one-third reduction in weight over a conventional aluminum peep, but also can provide strength characteristics comparable to and/or better than aluminum. Furthermore, when implemented, the method of manufacturing the present peep sight can provide a precisely and consistently manufactured peep sight having extremely precise tolerances.

These and other objects, advantages and features of the invention will be more readily understood and appreciated by reference to the detailed description of the invention and the drawings.

DETAILED DESCRIPTION OF THE INVENTION

I. Construction

Figure 1:
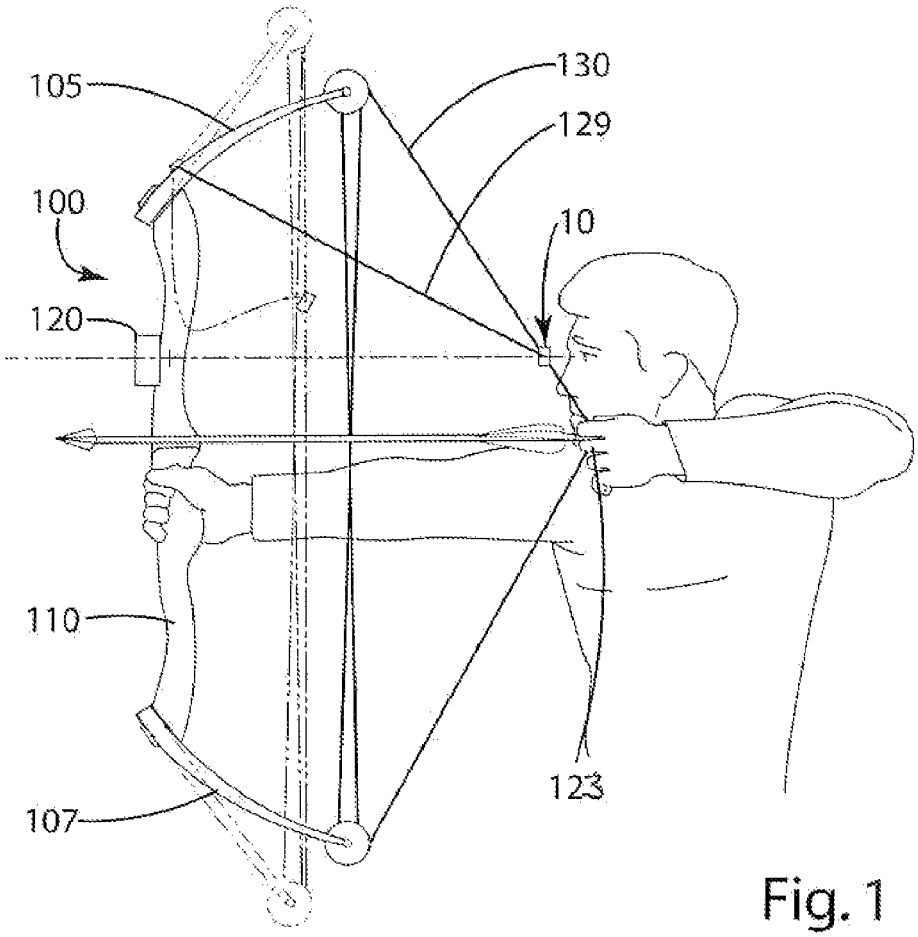
FIG. 1 is a side view of an archery peep sight in accordance with the present invention mounted on a conventional archery bow.

A peep sight in accordance with a current embodiment is shown in FIGS. 1-5 and generally designated 10. With reference to FIG. 1, the peep sight 10 can be used on a compound archery bow 100. Although described here in connection with a compound archery bow, it is to be understood that the peep sight can be used with a recurve bow, a long bow, or any other bow or projectile shooting device.

The compound bow 100 shown in FIG. 1 includes upper and lower limbs 105 and 107 joined with a riser 110. The compound bow further includes a front sight 120, a nocking point 123 and a bowstring 130. The bow 100 is shown in full lines in a drawn state, and is shown in broken lines in an undrawn state.

Referring to FIGS. 2-5, the peep sight 10 construction will now be described in more detail. The peep includes a body 12 having opposing surfaces—a front surface 14 and a rear surface 16. Because the front surface 14 is on the target side relative to the archer, it is also referred to herein as a target surface. Because the rearward surface 16 is on the archer side, it is referred to herein as the shooter surface. These target and shooter surfaces 14 and 16 can be parallel to one another as desired.

Figure 3:
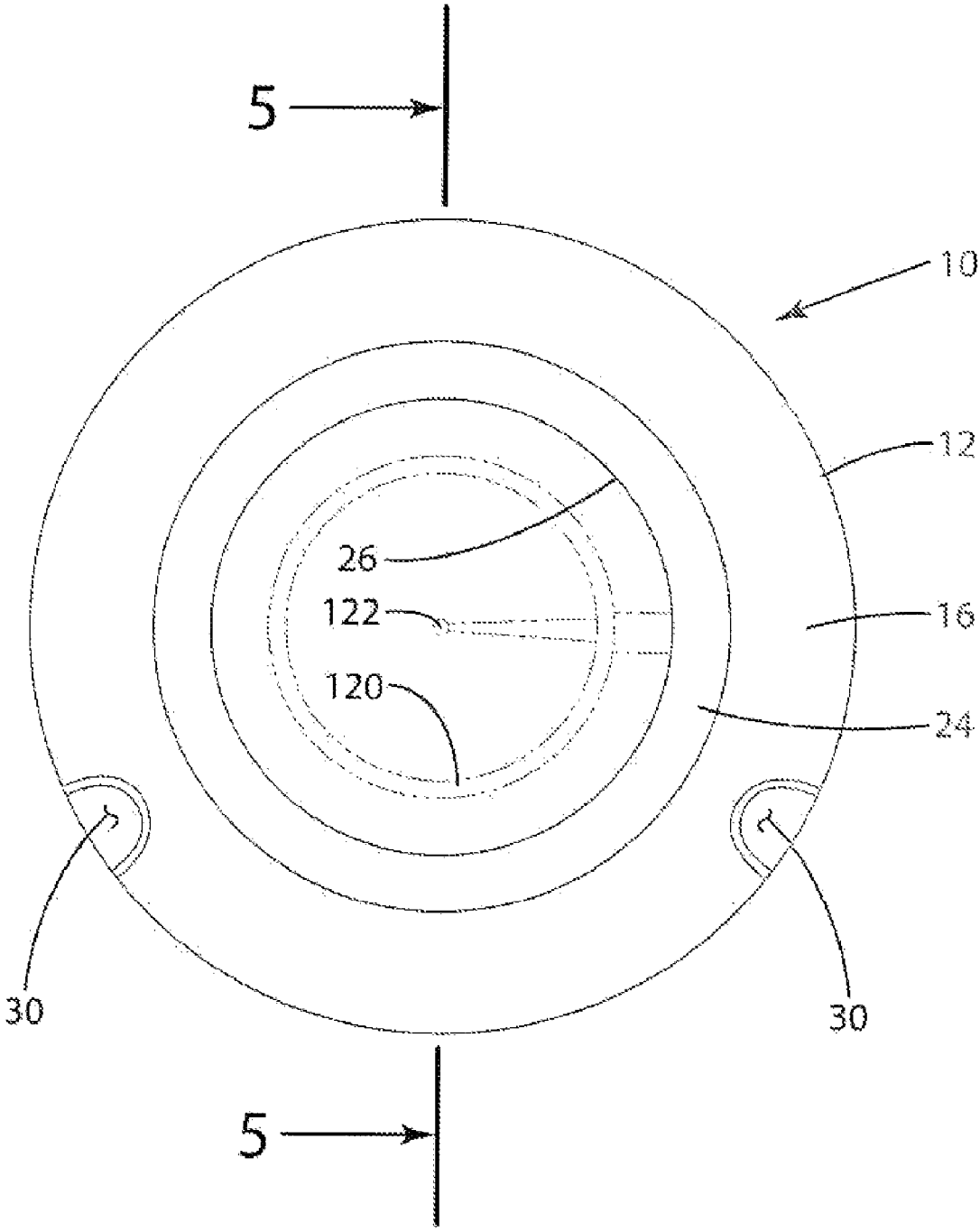
FIG. 3 is a view of the peep sight from the shooter side of the peep sight.
Figure 4:
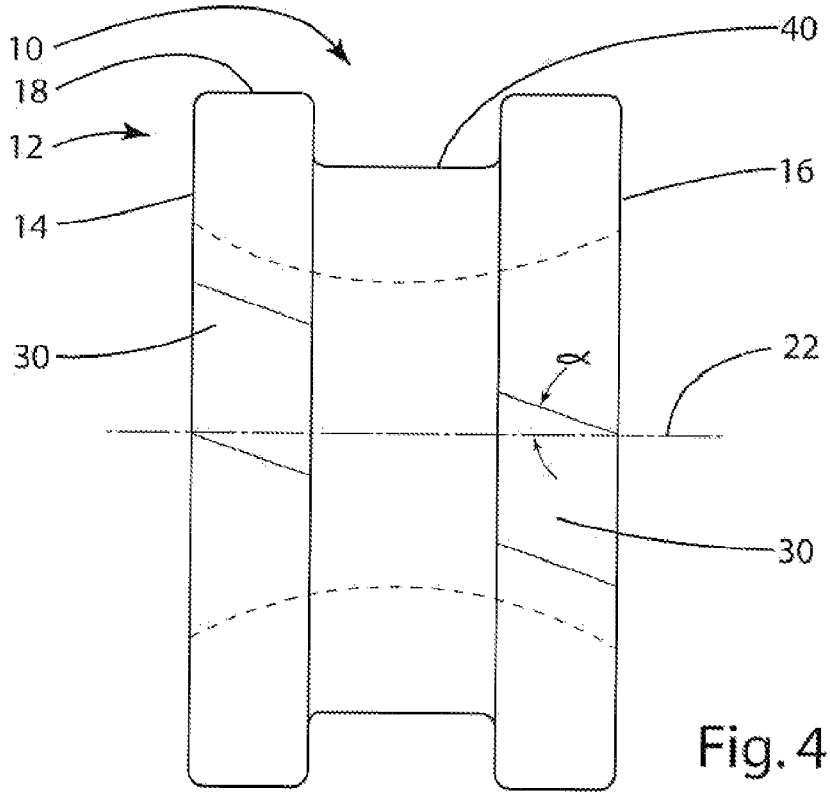
FIG. 4 is a side view of the peep sight.
Figure 5:
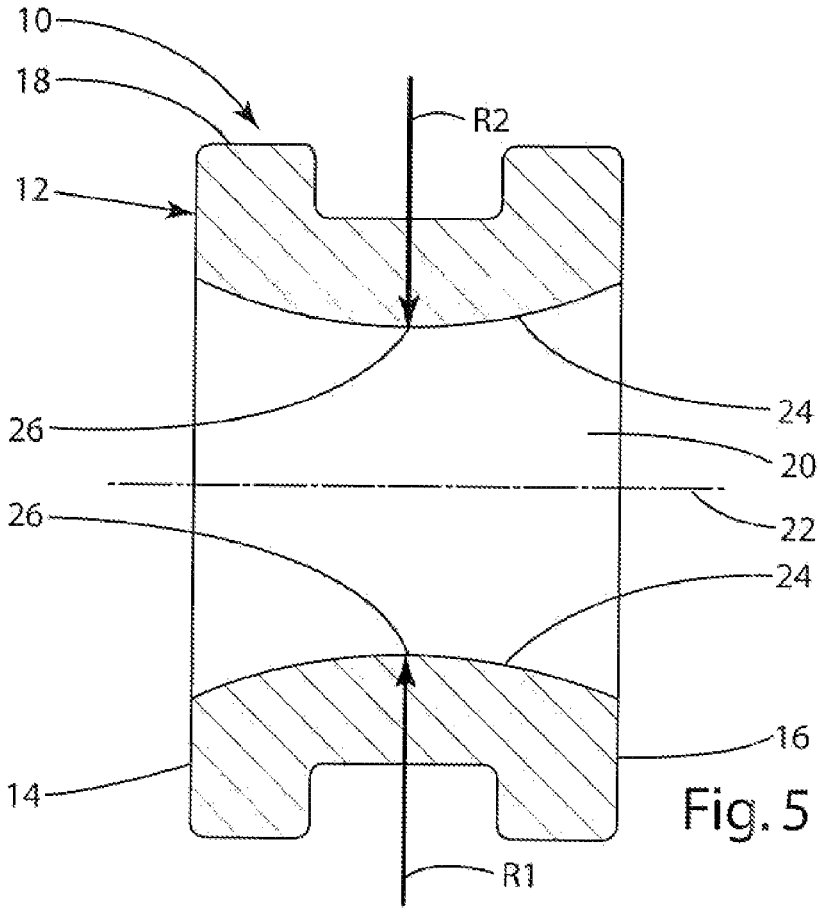
FIG. 5 is a cross-sectional view taken along line 5-5 in FIG. 3.
Figure 6:
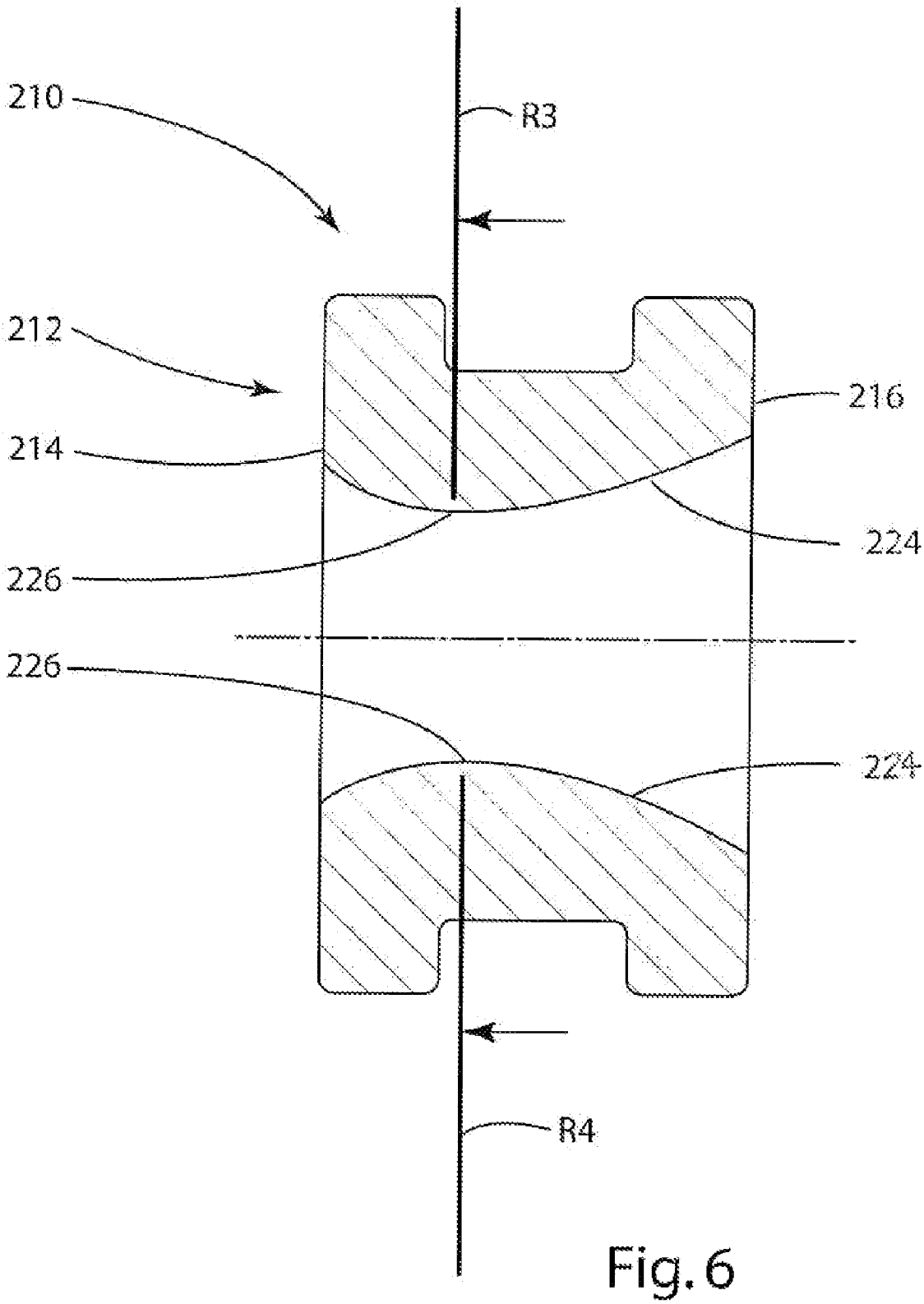
FIG. 6 is a cross-sectional view of an alternative embodiment of the peep sight.

As shown in FIGS. 3-5, the body 12 generally forms a circular disc; however, the body can take other geometric forms depending on the application. The body 12 also defines a peep aperture 20 that passes completely through the body. The peep aperture 20 can include a longitudinal axis 22 that is substantially orthogonal to the target surface 14 and/or the shooter surface 16. The aperture 20 is bounded by a curvilinear bulge 24. This bulge 24 forms or at least contributes to an hourglass configuration of the aperture when a cross section of the body 12 (FIG. 5) is considered. Where the curvilinear bulge circumferentiates the entire peep aperture, it can be referred to as a circumferential curvilinear bulge.

Figure 2:
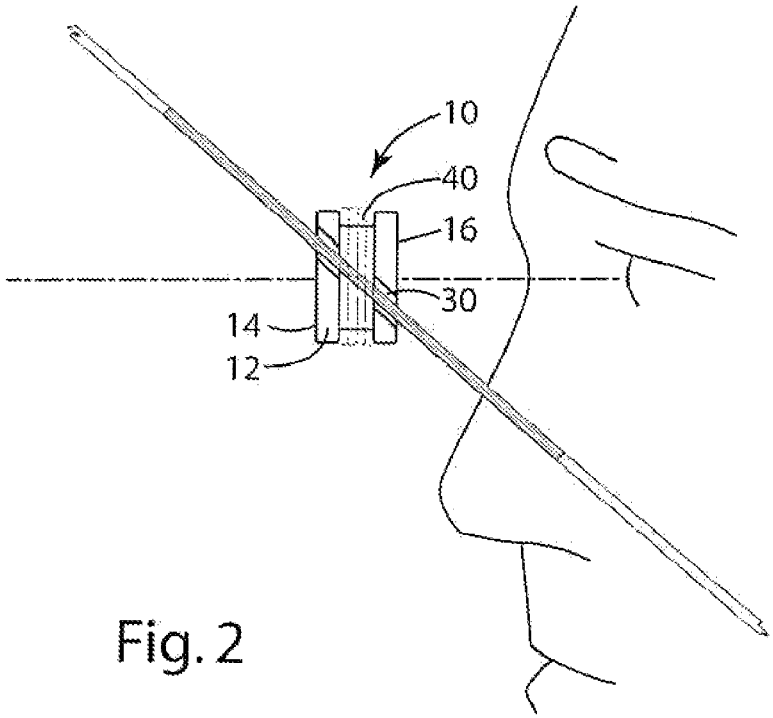
FIG. 2 is an enlarged side view of the peep sight with the bowstring in a drawn position.

The bulge 24 can be uniformly radiused around the entire circumference of the peep aperture. For example, as shown in FIG. 5, radius R1 is equal to radius R2 in the cross-sectional view shown there. Of course, the curvilinear bulge can be void of any true radius, for example, the bulge can be a parabolic shape that forms the circumferential boundary of the aperture. Further optionally, the bulge 24 can include an apex 26. This apex 26 can be positioned about midway between the target surface 14 and the shooter surface 16. As desired, however, this apex 26 can be closer to either surface. In effect, the apex, or area immediately adjacent the apex, usually forms the innermost, smallest boundary of the peep aperture when an archer peers through the aperture as shown in FIGS. 2 and 3. With the curvilinear bulge 24, a slight misalignment of the peep relative to a vertical plane when the bowstring is in the drawn position will not cause a significant distortion in the viewing aperture, and therefore will not be detrimental to aiming.

The body 12 can also include an outer surface 18 that surrounds the peep sight. This outer surface can be circumferential and can define a serving slot 40 around a substantial portion of the outer surface. The serving slot 40 can be of a uniform or varied depth and cross section. As shown, the cross section of the serving slot 40 is generally of a rectangular shape; however, square, rounded, elliptical or other geometric configurations can be used for the slot 40 as desired.

The peep sight body 12 can further define bowstring strand slots 30, which are designed to receive generally equal sized strand bunches from a multi-strand bowstring. The slots can be generally circular cross section; however, square, rounded, elliptical or other geometric configurations can be used for the slots 30 as desired. Where the slot cross section is circular so that it forms a cylindrical recess, the bottom of the recess can be common with the bottom of the serving slot 40. Regardless of the shape of either of the slots 30 and 40, these slots 30 and 40 can intersect one another.

Generally, as shown in FIGS. 2 and 3, the slots 30 are positioned at an angle $\alpha$ relative to the longitudinal axis 22 so that when the bowstring is in its drawn state, and thus at an angle different from an undrawn state, the longitudinal axis 22 is generally aligned with the front sight 122 and/or a target along the archer's line of sight. Further, the slots 30 can be defined by the outer surface 18 of the body 12 at approximately mirrored locations. This can facilitate balancing the peep 10 between the strands of the bowstring and alignment.

The peep sight 10 can be manufactured from a variety of materials. Preferably, it is manufactured from magnesium and/or magnesium alloy. Such a construction results in a weight reduction of a third over a similarly constructed aluminum peep. The peep of the present construction can be, however, constructed from other materials, such as aluminum, aluminum alloy or plastic, such as acrylic polyvinyl chloride, polypropylene, polyethylene and other polymers. When constructed from these other materials, the components may be cast, dipped, coated, extruded or injection molded. When constructed from magnesium or magnesium alloys or other metals such as aluminum, the peep can be manufactured using a Computer Numerical Control (CNC) machine, or any of the other manufacturing techniques mentioned above.

The components of the peep sight 10 can be of a variety of sizes. The outer diameter of the body 12 can have a maximum width or diameter of about 3/16" to about 5/8". The peep sight aperture diameter, for example, the diameter at the apex 26 of the curvilinear bulge 24, can vary in size from about 1/16" to about 5/8" depending on the application.

Finally, the peep sight 10 optionally can be colored to enhance light gathering ability and to facilitate low light shooting conditions. For example, in the embodiment shown, the entire peep sight 10, or merely the circumferential curvilinear bulge 24, can be anodized or otherwise treated with a blue material, that is, a material that reflects substantially only light having a wavelength between about 475 nanometers and about 510 nanometers. As desired, the peep sight 10 and/or its components can alternatively be black, white or other colors depending on the shooting application.

II. Method of Manufacture

The manufacture of the peep sight 10 will now be described. Generally, the peep sight 10 can be constructed from a magnesium, magnesium alloy or any other material. To begin manufacture, a material blank is positioned in a CNC machine. The machine performs a variety of operations, manipulating the blank to construct the peep 10. In those operations, the CNC machine creates the curvilinear bulge 24, forms the serving slot 40 and generates the string slots 30. The machine can also remove any sharp edges around the target surface 14 and the shooter surface 16, or elsewhere as desired. The machined peep optionally can be treated with a material to provide a blue color. Thereafter, the peep sight 10 is finished and readied for packaging.

III. Method of Mounting to an Archery Bow

With reference to FIGS. 1-2, a method of mounting the peep sight to a bow will now be described. Specifically, the peep sight 10 is mounted to an archery bow by separating the strands of the bowstring into two approximately equal strand bunches, and sliding the peep between the two strand bunches so that the strands come to rest in the strand slots 30. Preferably, the peep is inserted at a predetermined position along an archer's line of sight that is aligned when the bowstring is fully drawn as shown in full lines in FIG. 1. With the strands of the bowstring inserted in the slots 30, an optional serving (shown in phantom in FIG. 2) is wrapped around the serving slot 40 and tied to secure the peep sight 10 in the desired location on the bowstring. To prevent the peep sight 10 from misaligning with the archer's line of sight, a peep sight bowstring alignment tubing 129 (FIG. 1) can be used as desired.

IV. Method of Use

With reference to FIG. 1, the method of using the peep will now be described. As shown there, the bowstring is drawn from an undrawn state in broken lines to a drawn state in solid lines. Because the bowstring slots 30 are at an angle relative to the longitudinal axis 22 of the peep sight 10, they compensate for the realignment of the bowstring at its drawn state angle. Accordingly, the peep is aligned vertically, and with the archer's line of sight. Therefore, the archer can further align a forward sight pin 122 with the axis 22 of the peep, or some other desired alignment axis.

Because of the curvilinear bulge 24 and general construction of the peep, the peep provides improved contrast with a sight or target sighted through the peep aperture 20. The quality of the image is improved in low light conditions as the peep is able to gather more light. Further, when colored blue, the peep is comfortable and easy to view due to its similarity to the color of the sky. With the peep sight 10, an archer can aim consistently and easily, and accordingly, can achieve improved arrow groupings and overall accuracy.

V. Alternative Embodiment

In an alternative embodiment, the curvilinear bulge 24 of the peep sight 10 can be modified. Specifically, with reference to FIG. 7, the peep sight 210 includes a curvilinear bulge 224 wherein the radius of the bulge, that is, R3 and R4, which are of equal length (but optionally can be modified to be of varying length) are moved forward of the center in the direction of the arrows. Accordingly, the apex 226 is closer to the target face 214 than it is to the shooter face 216. The radius R3 and R4 can be moved forward and/or rearward depending on the application. For example, in another embodiment, the apex 226 can be closer to the shooter surface 216 than to the target surface 214.

Further alternatively, the bulge 224 can include compound radii. For example, the bulge 224 can be formed from multiple intersecting arcs of circles having different radii (not shown). Additionally, although shown as a portion of an arc of a circle, the bulge can be configured in the shape of a portion of an ellipse, a parabola, or any other geometric, curvilinear configuration. As used herein, when the bulge is constructed in such a curvilinear configuration, it is considered a "curvilinear bulge".

The above descriptions are those of the preferred embodiments of the invention. Various alterations and changes can be made without departing from the spirit and broader aspects of the invention as defined in the appended claims, which are to be interpreted in accordance with the principles of patent law including the doctrine of equivalents. Any references to claim elements in the singular, for example, using the articles "a," "an," "the," or "said," is not to be construed as limiting the element to the singular.

The embodiments of the invention in which an exclusive property or privilege is claimed are defined as follows:

1. A peep sight for an archery bow including a multi-strand bowstring comprising:

a body constructed from at least one of magnesium and magnesium alloy, the body including a target surface, a shooter surface, and an outer surface, the outer surface defining at least one bowstring strand slot, the strand slot configured to accept at least one strand of the multi-strand bowstring and secure the body at a pre-selected angle relative to the bowstring; and an aperture defined by the body passing from the shooter surface to the target surface, the aperture having a longitudinal axis, the aperture being bounded by a curvilinear bulge integral with the body and extending toward the longitudinal axis, the curvilinear bulge being located between the shooter surface and the target surface, the curvilinear bulge including an apex, the curvilinear bulge bulging toward the longitudinal axis in a curvilinear manner between the apex and at least one of the shooter surface and the target surface, whereby the curvilinear bulge improves visibility through the aperture for an archer aiming the bow.

2. The peep sight of claim 1 wherein the outer surface defines a serving slot that intersects the strand slot, the serving slot configured to accept a serving to secure the peep at a pre-selected location along the bowstring.

3. The peep sight of claim 1 wherein the apex is located about midway between the target surface and the shooter surface.

4. The peep sight of claim 1 wherein the apex is located closer to the target surface than the shooter surface.

5. The peep sight of claim 1 wherein the curvilinear bulge circumferentiates the aperture and is of a uniform radius.

6. The peep sight of claim 1 wherein the aperture is substantially circular when viewed by an archer along the longitudinal axis and when the archery bow is in a drawn state.

7. A peep sight for an archery bow having a multi-strand bowstring comprising:

a body having a front surface, an opposing rear surface, an outer surface, and a longitudinal axis, the body defining an aperture that is bounded by a curvilinear bulge integral with the body and bulging toward the longitudinal axis in a curvilinear manner between the front surface and the opposing rear surface, the bulge being of a curved hourglass configuration when viewed from a cross section taken through the longitudinal axis of the body;

a strand slot defined by the outer surface and projecting from the front surface to the rear surface, wherein strands of the multi-strand bowstring are at least partially disposed within the strand slot, wherein the longitudinal axis of the aperture is aligned with a line of sight of an archer who draws the bowstring when aiming the archery bow for shooting, whereby the curved hourglass configuration facilitates rapid target acquisition and aiming for the archer, enhances contrast between the peep sight and the target, and is suitable for low light shooting conditions.

8. The peep sight of claim 7 wherein the body is constructed substantially from at least one of a magnesium and magnesium alloy.

9. A peep sight for an archery bow having a multi-strand bowstring comprising:

a body having a front surface, an opposing rear surface, an outer surface, and a longitudinal axis, the body defining an aperture that is bounded by a curvilinear bulge, the body constructed substantially from at least one of a magnesium and magnesium alloy:

a strand slot defined by the outer surface and projecting from the front surface to the rear surface wherein strands of the multi-strand bowstring are at least partially disposed within the strand slot wherein the longitudinal axis of the aperture is aligned with a line of sight of an archer who draws the bowstring when aiming the archery bow for shooting:

wherein the body is treated with a material so that at least the curvilinear bulge reflects substantially only light of wavelengths between about 475 nanometers and 510 nanometers.

10. The peep sight of claim 9 wherein the outer surface defines a serving slot, and wherein at least a portion of the strand slot intersects the serving slot.

11. The peep sight of claim 10 wherein the serving slot has a rectangular cross section.

12. The peep sight of claim 2 wherein the curvilinear bulge forms an apex that is located about midway between the front surface and the rear surface of the body.

13. The peep sight of claim 2 wherein the curvilinear bulge provides the aperture with an hourglass configuration.

14. The peep sight of claim 2 wherein the curvilinear bulge circumferentiates the aperture, and includes a surface projecting toward the longitudinal axis, that surface having a substantially uniform radius.

15. A method of manufacturing a peep sight for a multi-strand archery bow, the peep sight including a body constructed from at least one of magnesium and magnesium alloy, the body including a target surface, a shooter surface, and an outer surface, the outer surface defining at least one bowstring strand slot, the strand slot configured to accept at least one strand of the multi-strand bowstring and secure the body at a pre-selected angle relative to the bowstring, the peep sight including an aperture defined by the body passing from the shooter surface to the target surface, the aperture having a longitudinal axis, the aperture being bounded by a curvilinear bulge extending toward the longitudinal axis, whereby the curvilinear bulge improves visibility through the aperture for an archer aiming the bow, the method comprising:

providing a blank constructed from at least one of magnesium and a magnesium alloy material; and machining the blank to remove material, form at least the body and define the aperture bounded by the curvilinear bulge.

16. The method of claim 15 comprising treating the body so that the body reflects substantially only light of wavelengths between about 475 nanometers and 510 nanometers.

17. A method of manufacturing a peep sight for a multi-strand archery bow, the peep sight including a body having a front surface, an opposing rear surface, an outer surface, and a longitudinal axis, the body defining an aperture that is bounded by a curvilinear bulge, the peep sight including a strand slot defined by the outer surface and projecting from the front surface to the rear surface, wherein strands of the multi-strand bowstring are at least partially disposed within the strand slot, wherein the longitudinal axis of the aperture is aligned with a line of sight of an archer who draws the bowstring when aiming the archery bow for shooting, the method comprising:

providing a blank constructed from at least one of magnesium and a magnesium alloy material; and machining the blank to remove material, form at least the body and define the aperture bounded by the curvilinear bulge.

18. The method of claim 17 comprising treating the body so that the body reflects substantially only light of wavelengths between about 475 nanometers and 510 nanometers.

19. The method of claim 17 comprising machining the body so that it forms a disc like shape and drilling the body so that the curvilinear bulge circumferentiates the aperture.

* * * * *

UNITED STATES PATENT AND TRADEMARK OFFICE

CERTIFICATE OF CORRECTION

PATENT NO. : 7,543,389 B2
APPLICATION NO. : 11/549388
DATED : June 9, 2009
INVENTOR(S) : Grace, Jr.

It is certified that error appears in the above-identified patent and that said Letters Patent is hereby corrected as shown below:

Column 7, Claim 12, Line 10:
"2" should be --9--

Column 7, Claim 13, Line 13:
"2" should be --9--

Column 7, Claim 14, Line 15:
"2" should be --9--

Signed and Sealed this

First Day of December, 2009

David J. Kappos

David J. Kappos
*Director of the United States Patent and Trademark Office*